US006233892B1

(12) United States Patent
Tylman

(10) Patent No.: US 6,233,892 B1
(45) Date of Patent: May 22, 2001

(54) STRUCTURAL PANEL SYSTEM

(75) Inventor: Vincent R. Tylman, Lake Oswego, OR (US)

(73) Assignee: The Namlyt Company, Lake Oswego, OR (US)

( * ) Notice: Subject to any disclaimer, the term of this patent is extended or adjusted under 35 U.S.C. 154(b) by 0 days.

(21) Appl. No.: 09/366,253

(22) Filed: Aug. 3, 1999

Related U.S. Application Data

(63) Continuation-in-part of application No. 08/958,761, filed on Oct. 25, 1997, now abandoned.

(51) Int. Cl.[7] ..... E04C 2/292

(52) U.S. Cl. ..... 52/309.12; 52/309.5; 52/309.7; 52/408; 52/588.1; 52/783.11; 52/794.1; 52/798.1

(58) Field of Search ..... 52/309.4, 309.5, 52/309.7, 309.12, 309.15, 309.17, 408, 404.1, 411, 588.1, 794.1, 791.1, 795.1, 796.1, 746.1, 742.13, 783.1, 783.11, 800.11

(56) References Cited

U.S. PATENT DOCUMENTS

| | | | | |
|---|---|---|---|---|
| 2,304,718 | | 12/1942 | Swart . | |
| 2,858,916 | | 11/1958 | Josephs . | |
| 3,000,144 | * | 9/1961 | Kitson | 52/309.12 X |
| 3,555,756 | | 1/1971 | Curran et al. . | |
| 3,566,568 | * | 3/1971 | Slobodian | 52/305.7 |
| 3,641,730 | | 2/1972 | Meckstroth . | |
| 3,646,715 | | 3/1972 | Pope . | |
| 3,711,363 | * | 1/1973 | Jarema et al. | 52/309.15 X |
| 3,732,138 | | 5/1973 | Almog . | |
| 3,736,715 | | 6/1973 | Krumwiede . | |
| 3,777,430 | | 12/1973 | Tischuk . | |
| 3,782,049 | * | 1/1974 | Sachs | 52/309.12 X |
| 3,868,801 | | 3/1975 | Weiner . | |
| 3,886,706 | | 6/1975 | Baker . | |
| 3,965,635 | | 6/1976 | Renkert . | |
| 3,971,184 | * | 7/1976 | Van Wagoner | 52/408 X |
| 4,030,252 | | 6/1977 | Dean . | |
| 4,069,639 | | 1/1978 | Lindner et al. . | |
| 4,107,885 | | 8/1978 | Lindal . | |
| 4,107,891 | | 8/1978 | Cotton, Jr. et al. . | |
| 4,110,948 | | 9/1978 | Maier, Jr. . | |
| 4,114,335 | | 9/1978 | Carroll . | |
| 4,122,641 | | 10/1978 | Bard et al. . | |
| 4,122,643 | | 10/1978 | Hafner . | |
| 4,128,975 | | 12/1978 | Abate . | |
| 4,157,640 | | 6/1979 | Joannes . | |
| 4,161,087 | | 7/1979 | Levesque . | |
| 4,187,653 | | 2/1980 | Kliewer . | |
| 4,223,500 | | 9/1980 | Clark et al. . | |
| 4,234,634 | | 11/1980 | Longinotti . | |
| 4,265,067 | | 5/1981 | Palmer . | |
| 4,288,962 | | 9/1981 | Kavanaugh . | |
| 4,334,394 | | 6/1982 | Mäder . | |

(List continued on next page.)

OTHER PUBLICATIONS

"Building Systems Technology; Quality Construction For The 21st Century and Beyond" brochure; 1995; 10 pages.

*Primary Examiner*—Carl D. Friedman
*Assistant Examiner*—Winnie Yip
(74) *Attorney, Agent, or Firm*—Fasth Law Offices; Rolf Fasth

(57) ABSTRACT

A structural panel system that has two skin members that are separated by a plurality of semi-flexible support members disposed therebetween. The support members and the skin members are adhered together by a semi-flexible core member. The outer skin member is movable relative to the inner skin member. The first skin member may be perforated and encapsulated by either the core member or a cementitious material to provide a variety of panel surfaces.

20 Claims, 6 Drawing Sheets

U.S. PATENT DOCUMENTS

| | | | | |
|---|---|---|---|---|
| 4,472,919 | | 9/1984 | Nourse . | |
| 4,525,965 | | 7/1985 | Woelfel . | |
| 4,541,870 | | 9/1985 | Barrett, Jr. . | |
| 4,548,007 | | 10/1985 | Newman . | |
| 4,637,187 | | 1/1987 | Campbell . | |
| 4,642,950 | | 2/1987 | Kelly . | |
| 4,642,960 | | 2/1987 | Wallover, III . | |
| 4,642,963 | | 2/1987 | Borges . | |
| 4,649,677 | | 3/1987 | Oldham . | |
| 4,649,680 | | 3/1987 | Weisner et al. . | |
| 4,649,682 | | 3/1987 | Barrett, Jr. . | |
| 4,649,684 | | 3/1987 | Petree et al. . | |
| 4,649,686 | | 3/1987 | Backenstow et al. . | |
| 4,649,689 | | 3/1987 | Everman et al. . | |
| 4,741,139 | | 5/1988 | Campbell . | |
| 4,743,485 | | 5/1988 | Ting . | |
| 4,805,366 | | 2/1989 | Long . | |
| 4,837,999 | | 6/1989 | Stayner . | |
| 4,894,974 | | 1/1990 | Mayhew et al. . | |
| 4,896,469 | | 1/1990 | Wright . | |
| 4,920,720 | | 5/1990 | LaBianca . | |
| 4,936,069 | | 6/1990 | Hunter et al. . | |
| 5,048,254 | | 9/1991 | Merlau . | |
| 5,123,222 | | 6/1992 | Guarriello et al. . | |
| 5,190,803 | | 3/1993 | Goldbach et al. . | |
| 5,191,745 | | 3/1993 | Story . | |
| 5,224,315 | | 7/1993 | Winter, IV . | |
| 5,351,455 | * | 10/1994 | Schoonover et al. | 52/410 |
| 5,373,674 | | 12/1994 | Winter, IV . | |
| 5,390,466 | * | 2/1995 | Johnson et al. | 52/796.1 |
| 5,396,750 | | 3/1995 | Kleyn . | |
| 5,471,804 | | 12/1995 | Winter, IV . | |
| 5,471,806 | | 12/1995 | Rokhlin . | |
| 5,842,315 | * | 12/1998 | Lin | 52/309.9 |

* cited by examiner

STRUCTURAL PANEL SYSTEM

PRIOR APPLICATION

This is a continuation-in-part application of U.S. patent application Ser. No. 08/958,761, filed Oct. 25, 1997, now abandoned.

TECHNICAL FIELD

The invention relates to a structural panel system that provides a very fast and reliable way of building wall, floor and roof structures.

BACKGROUND INFORMATION AND SUMMARY OF THE INVENTION

With diminishing timber resources, there is an increasing demand for effective replacements of wood as a building material. The prior art methods have been either too complicated or too expensive to seriously impact the potential market. Other drawbacks with the prior art technologies are that they are cumbersome to handle, and the finished wall/roofing systems often lack aesthetic appeal.

Additionally, in conventional panelized building designs, it is often necessary use internal horizontal purlins or diagonal cross bracing to provide sufficient strength and rigidity to the structure. These required extra support members not only increase costs and reduce design options but also detract from the aesthetic appeal of the interior of the building structure.

When structural panel systems are used in a roofing or flooring application, it is desirable to provide a load-carrying capability across a given span. In a roofing application, it is also desirable to provide a sufficient pull-apart strength that will withstand uplift forces created during high wind situations. The roofing and wall panel systems should also have good insulation capability and be resistant to water leakage. It is also desirable for structural panels to be lightweight and easy to install. Further, because of the increasing costs and lack of availability of quality lumber materials, it is desirable to use as few wood components as possible. The panel system of the present invention provides all of the above-listed requirements.

The structural panel system of the present invention may have two parallel skin panels that are separated by a plurality of polymeric support members disposed therebetween. The support members may be attached to the skin panels by a very high bonding tape that has a strong adhesive on both sides and a high-strength tape material. An alternative method of attaching the skins to the support members is by the use of self-drilling, self-tapping sheet metal screws. The outer skin panel is movable relative to the inner skin panel so that no stresses are transferred to the inner skin panel that is secured to the red-iron structure. A semi-rigid core material may be injected into a space defined by the skin panels and the support members to further improve the strength of the panel system. The core material may be used to adhere the skin panels and the support members together. A decorative panel such as a cementitious panel, stucco panel, etc., may be attached to or assembled as an integral part of the outer skin member.

DETAILED DESCRIPTION

Figure 1:
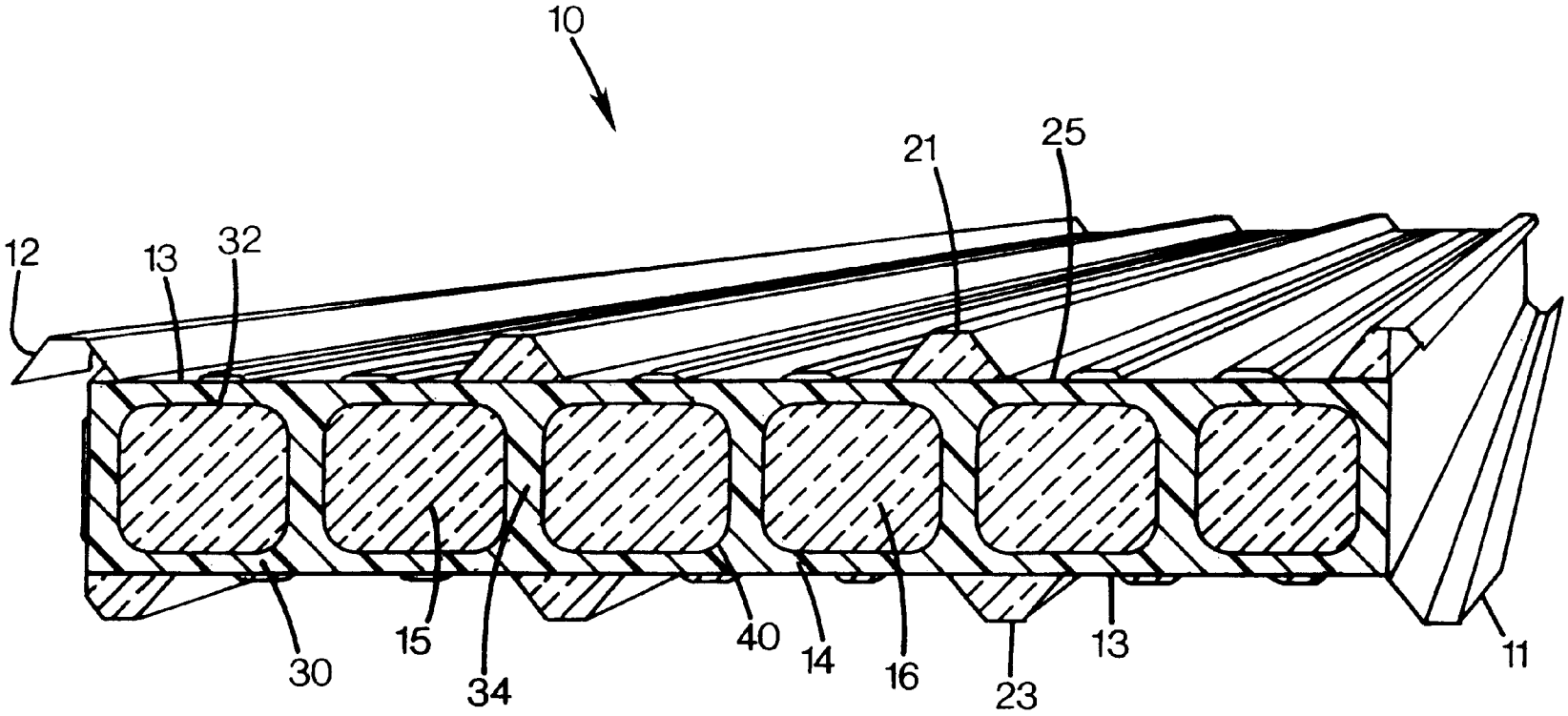
FIG. 1 is an end view of the panel system of the present invention.

With reference to FIG. 1, the panel system 10 of the present invention preferably includes two parallel skin panels 11, 12 that are separated and supported by semi-flexible support members 14. It is to be understood that the skin panels do not necessarily have to be parallel to one another. The skin panels 11, 12 may be made of steel, fiberglass, wood, or any other suitable skin or panel material. The support members 14 could be any type of a separator such as a polymeric channel having a suitable size and shape. The spacing of the support members 14 between the skin panels 11, 12 directly affects the physical properties of the panel system 10. The more support members 14 that are used, and the closer the support members are placed relative to one another, the stiffer the panel system 10 becomes. For example, the support members 14 may be spaced at about 3-foot to 5-foot intervals along the length of the panel system 10. The structural panels 10 may be used to form a vertical wall system and/or a slanting or horizontal roofing system, as described in detail below.

The skin panels 11, 12 may be attached to the support members 14 by a high-bond adhesive tape 13 such as 3M's VHB tape (very high-bond tape). Preferably, the adhesive tape 13 has a tensile strength of between about 20–140 p.s.i. More preferred, the tensile strength is between about 70–140 p.s.i. Most preferred, the tensile strength is between about 110–140 p.s.i. Preferably, the adhesive tape has a shear strength of between about 20–80 p.s.i. More preferred, the shear strength is between about 40–80 p.s.i. Most preferred, the shear strength is between about 70–80 p.s.i.

The tape is preferred to conventional fasteners, such as screws, because there is less risk of leakage, although screws may be used in conjunction with the VHB tape. This leak-free feature is particularly important when the panel system 10 is used in a roofing system. However, it is to be understood that the support members may also be attached to the skin panels with conventional fasteners such as screws, bolts, or other suitable fasteners.

As shown in FIG. 1, the support members 14 are preferably elongate polymeric stiffener members having a plurality of square, round, or other shaped holes 15 defined therethrough. Each support member 14 has two elongate parallel side members 30, 32 that are connected by transverse members 34 so that the holes 15 are formed by the side members and the transverse members. Each corner of the hole 15 may be reinforced by corner section 40 to further improve the stiffness of the support member 14. Preferably, the corner section 40 is integral with the side members and the transverse members.

If necessary, one support member may safely be stacked on top of or interlocked with another support member for greater strength and holding power. This stacking and/or interlocking feature makes it easier to store the support members, and two or more support members can be stacked on top of one another in areas of the wall structure that are subjected to very high load. In other words, the support members may be nested together to add strength to the panel system when needed so that any stress force may be transferred from one support member to the next support member. When the support members 14 are locked together into a set, the set provides increased strength compared to having several individual support members simply placed next to one another.

With reference to FIG. 1, a semi-rigid foam material 16 may be used as an insulation and core material. When the semi-rigid foam material is used, the foam material and the support members together act as the compression members between the skin panels. The foam material 16 may be bonded to the support members 14 and to the inner and outer skin panels 11, 12 so that the support members 14, the skin panels 11, 12 are adhered together by the foam material 16 itself. Of course, an additional adhesive may be applied to the foam material 16 to further strengthen the bond between the foam material and the support member and the skin panels.

The panel system 10 has a thickness ranging from about 3.5 inches or less to 12 inches or more that provides a wide range of insulation factors as well as a wide range of strength and stiffness characteristics to meet both engineering and architectural requirements.

The semi-rigid foam material 16 not only improves the strength properties of the support member 14 but may also be used to form a suitable outer surface, as described in detail below. The inner skin panel 11 and/or the outer skin panel 12 are perforated to permit the core-material 16, such as a foam material, to expand therethrough. Prior to the foam material 16 being cured, a planer non-stick outer molding panel may be used as a molding surface that is then removed so that a more permanent outer panel material or coating may be attached to the outer foam surface, such as cement board or stucco. The outer molding panel ensures that the skin panels are held in place and not pushed apart by the forces created when the foam material 16 is expanding.

Figure 2:
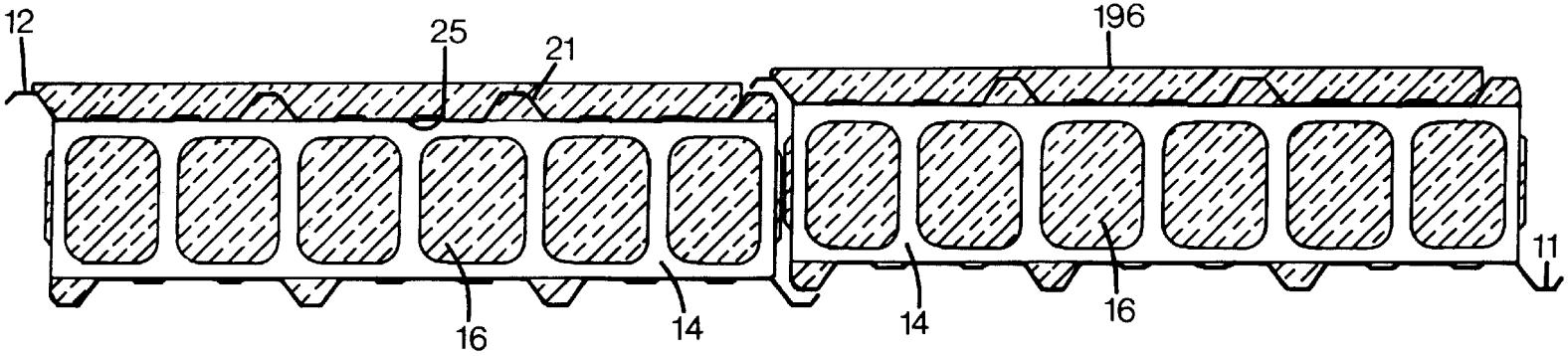
FIG. 2 is an end view of a first panel system having a first skin surface composed of the core material and being attached to an identical second panel system.
Figure 6:
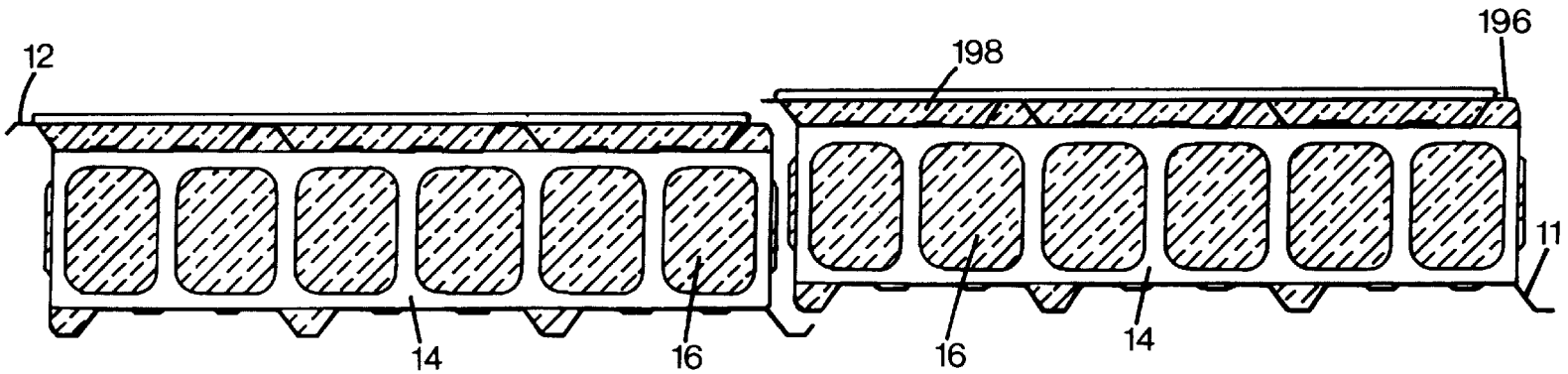
FIG. 6 is an end view of a first panel system having a third skin member bonded to the panel by the core material and being attached to an identical second panel system.

FIG. 2 shows such a panel system wherein an outer surface 196 of the panel is formed from the core member material 16. The foam material may be a urethane semi-rigid foam that that may be used as a bonding agent. As best shown in FIG. 6, as the foam material expands through the holes, a suitable outer skin may be attached to or by the semi-rigid urethane foam and be bonded to the panel system. The outer skin may be a cement board, dry wall, strand board, or any other suitable outer skin.

More particularly, because a chamber is formed between the flat segments 25 and the ribs 21, the unexpanded foam material 16 is permitted to penetrate into the chamber through holes formed in the skin panel 12 and bear against a non-stick mold surface that is close to the outer skin panel 12. This produces a flat foam surface onto which an acrylic stucco or any other suitable finishing panel may be bonded. Similarly, a finishing panel may also be bonded to the inside of the panel system. The cementitious skin 20 may also be bonded to the flat foam surface. Because the support members 14 are bonded to the skin panels, the skin panels 11, 12 are held together while the foam material 16 is expanding between the skin panels and towards the non-stick mold surface.

The panel system of the present invention provides for triple protection against leakage. If a standing seam or other exterior surface is used and water somehow penetrates the exterior surface, the closed-cell foam material prevents the water from going further into the panel system. Even if water manages to go through the foam material, the inner skin panel would prevent the water from penetrating or lead it away into a gutter. The panel system may be specifically designed in such a way that water is lead away from the panel system by the inner skin panel directly into a gutter.

The inner skin panel 11 may be firmly attached to the red-iron skeleton of a building so that the outer skin panel 12 can expand and contract separately from the structure. Because the outer skin panel 12 is attached to the red-iron structure via the support members 14, the outer skin panel 12 is free to expand and contract independently of the red-iron structure and, therefore, does not transfer stresses to the inner skin panel 11 or to the red-iron structure to which the inner skin panel 11 is attached.

Figure 3:
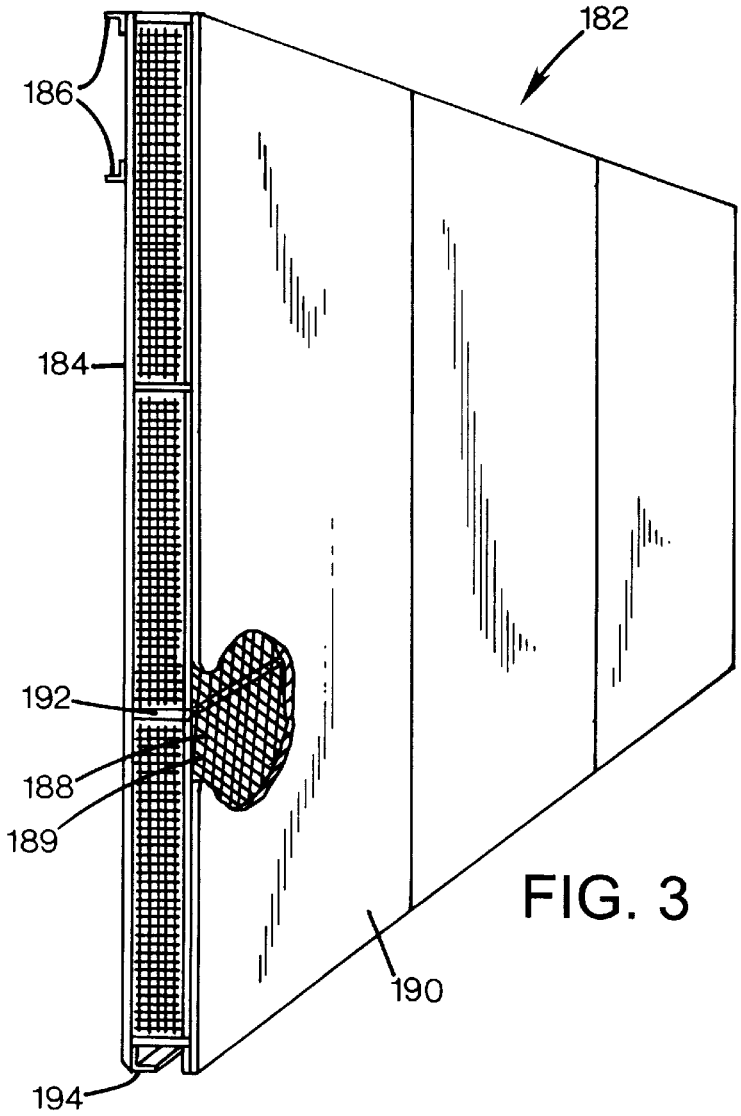
FIG. 3 is a perspective view of a vertical wall system having a foam core member and a cementitious outer surface.

The support members 14 are also designed to "float" on the foam material 16 so the support members are in turn supported by the foam material 16 in the vertical direction if the panel system is used as a vertical wall structure (as best seen in FIG. 3). Therefore, the outer steel skin 12 (along with a cementitious or other additional skin) is supported by compressing the foam material 16. The latter compression feature only applies to vertical wall structures.

With reference to FIG. 1, when the panel 10 is used in a wall system, the inner skin panel 11 may be firmly attached to a footing or a foundation of the building as well as the girders or bar joists at the top of the building structure. The outer skin panel 12 may be partially supported by resting on the foundation of a building structure. However, if so desired, the outer skin panel 12 may be entirely supported by the support members 14 that are attached to both the inner and outer skin panels 11, 12.

Because the inner skin panel 11 is not subject to the same forces that are caused by thermal expansion and contraction, the inner skin panel 11 can be fixedly attached to the internal red-iron structure. The vertical skin panels may also be attached to each other, such as by screwing one skin to another skin, thus forming a continuous drum-head-like surface that reinforces the entire red-iron structure. This feature may reduce or eliminate the need for horizontal purlins and cross braces that are found in most metal buildings. This attachment of the skin panels to the red-iron structure also substantially improves the wind-load and seismic-load capabilities of the panel system. The combination of the drumhead engineering and the stress skin structure of the panel system provides a system that substantially increases the overall strength of the building structure.

As best shown in FIG. 3, the vertical wall system may be a tilt-up panel system 182 that has the inner skin panel 184 attached to a red iron framework 186. An outer skin member 188 has a plurality of openings 189 defined therein so that a cementitious exterior surface 190 may be made to encapsulate the outer skin member and the outer lips of the support members 192. The inner skin panel 184 may also be attached to a footing member 194.

In certain applications, it may desirable to clad the outside surface of the panel system with an exterior finish panel. In an alternative embodiment, a fast-setting cementitious material may be cast around the outer skin member of the panel system during the manufacturing process of the panel system, as shown, for example, in FIGS. 4 and 5. If the extra finish panel is heavy, it is possible to use an extra number of support members in the panel system to provide sufficient strength.

As mentioned above, several support members may also be interlocked together to provide even better strength, and the inside, between the inner and outer skin panels, may be filled with the semi-rigid foam or other core material to further add to the strength characteristics of the panel system. Also, the transverse members of the support members transfer the downward rotational force the is created by the weight of the outer skin panel to a compression load on the semi-rigid foam or other core material. As opposed to a conventional panel system, there is no need to solely rely on the shear strength of the foam material itself or on the shear bond that exists between the core material and the outer skin panel. The downward force created by the relatively heavy cementitious outer panel is carried by the support members, which are, in turn, supported by the core material.

Because the foam-filled panel system is very stiff and rigid, the panel system provides an excellent platform for structural applications. The cast cementitious material provides excellent fire protection, weather resistance, impact resistance, and interesting aesthetic appearances. Almost any type of surface can be cast around the outer panel skin member, thus providing a brick-, stucco-, wood-like appearance, or other architecturally pleasing appearance.

Figure 4:
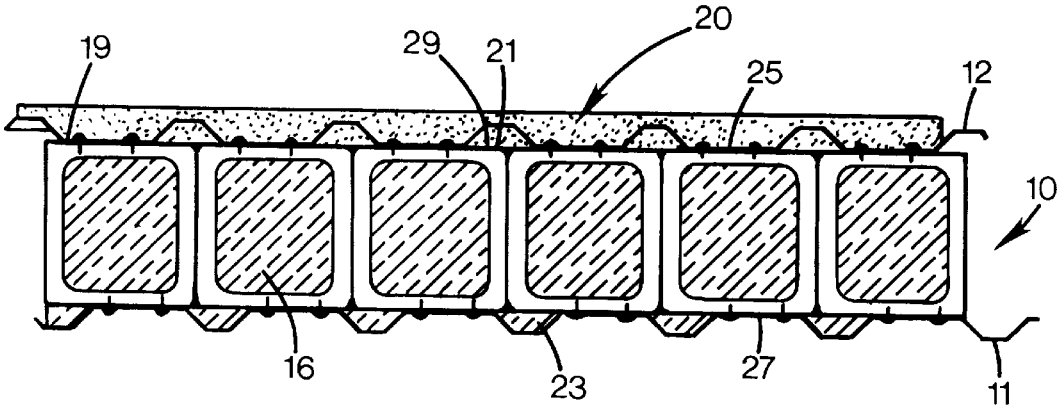
FIG. 4 is an end view of the foam-filled panel system having a cast outer cementitious surface material that is cast around a perforated rib in the outer skin causing the rib member to become an internal reinforcing member of that outer skin.

As best shown in FIG. 4, a cementitious skin 20 may be attached to the outer surface 19 of the foam material 16 and to the protrusion segments 21 of the steel skin 11 to provide a finished look. This feature greatly reduces the cost of providing a non-metal finish for the panel system 10. Furthermore, the combination of the cementitious skin 20 and the skin panels 11, 12 improves the strength characteristics of the compression member of the panel system under severe loading conditions.

As shown in FIG. 4, it is also possible to provide the ribs 29 of the skin panels 11, 12 with perforations so that, when the cementitious material is cast on the surface of, for example, the outer skin panel 12, the cement is permitted to flow through the holes in the ribs and therefore mechanically encapsulates the ribs of the outer skin panel 12 when the cement is cured. The outer skin panel 12 then becomes a reinforcing member for the cementitious material 20. It has been found that magnesium oxyphosphate or magnesium oxychloride cements are particularly suitable because they are fast setting, relatively lightweight, and very fire resistant. Other materials could also be used, but magnesium oxyphosphate is preferred because, not only is the material fast setting, but it also adheres well to metal surfaces. It is also possible to use an embossed skin panel instead of a perforated skin panel.

FIG. 6 shows a panel system wherein a sheet stock material 198 has been bonded to outer surface 196 of the panel system by the core member material 16. These panel systems are discussed in more detail below.

Figure 7:
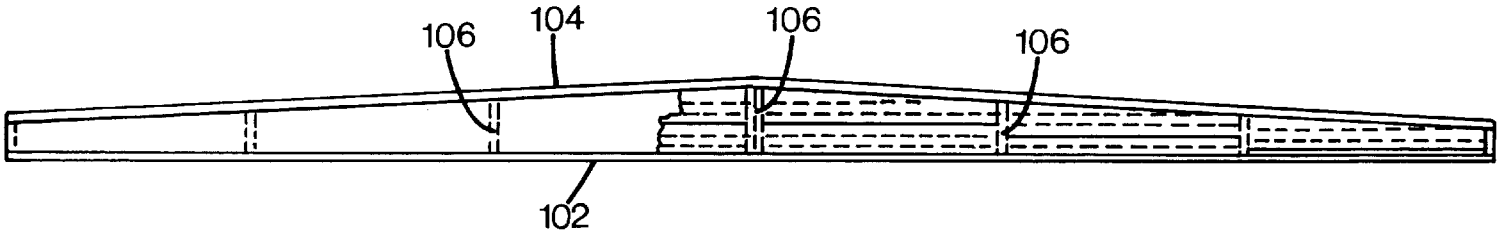
FIG. 7 is a side view of a panel using support members of varying height to cause non-parallel panel surfaces.

FIG. 7 illustrates an alternative embodiment of the panel system of the present invention. Instead of using two parallel skins, this embodiment has one relatively flat skin panel 102 and a bent or convex shaped skin panel 104. It is to be understood that the skin panel may also have a concave shape or form an obtuse angle with the first skin panel so that the two skin panels are not parallel.

Because the skin panel is not flat, support members 106 having different heights may be used. In a span loading application, the highest load stress most often occurs in the center of the panel system. A panel that has greater thickness in the center therefore has its greatest strength at the highest potential stress point. Another important feature of this embodiment is that less relatively expensive core material is required. Also, the panel system may conveniently be used as a roof system because the panel system may be provided with a suitable pitch.

Figure 5:
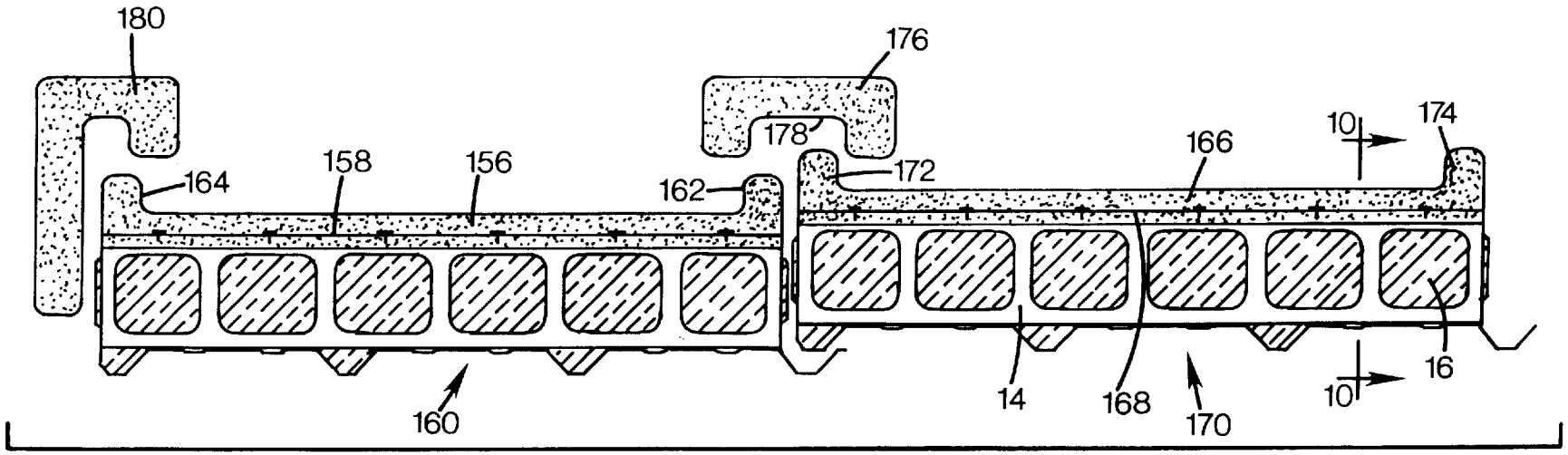
FIG. 5 is an end view of the foam-filled panel system having a cast outer cementitious surface material that is cast around and encapsulates the outer skin member.

With reference to FIG. 5, an outer cementitious panel 156 may be cast around an outer skin panel 158 of a first panel system 160. The cementitious skin member 156 may have a first outer ridge 162 and a second outer ridge 164 that both protrude outwardly. Similarly, an outer cementitious skin member 166 may be formed around an outer skin member 168 of a second panel system 170. The panel 166 may have a first outer ride 172 and a second outer ridge 174 that both protrude outwardly. When the panel system is used as a roofing panel, it is preferable to place a U-shaped seam cap 176 over the ridges 162, 172, so that the ridges extend into a cavity 178 defined in the seam cap 176 to provide further protection against undesirable water penetration between the panels attached to one another. If the ridge, such as the ridge 164, is at the end of the panel roofing assembly, an L-shaped end cap 180 may be placed over the ridge 164.

Figure 8:
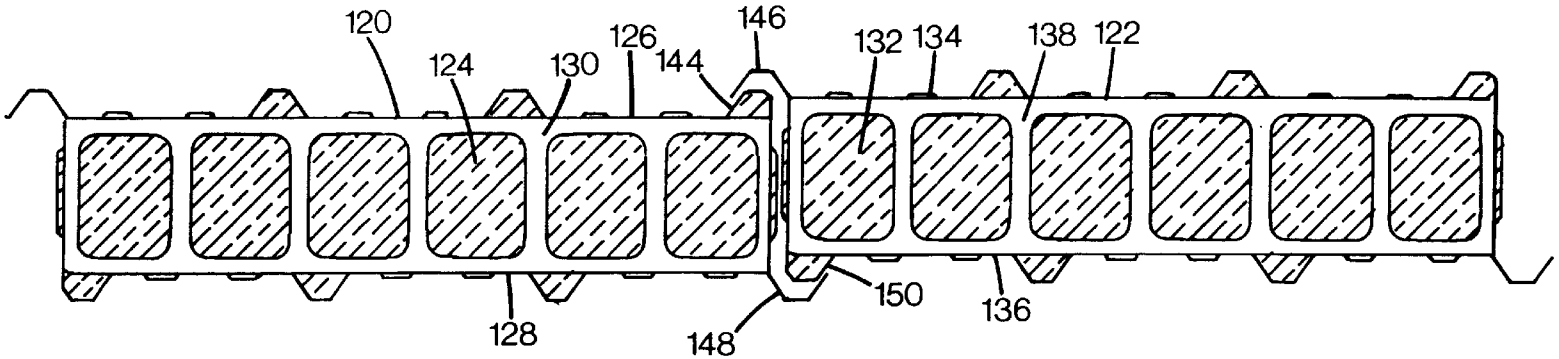
FIG. 8 is an end view of a first panel system that is attached to a second panel system.
Figure 9:
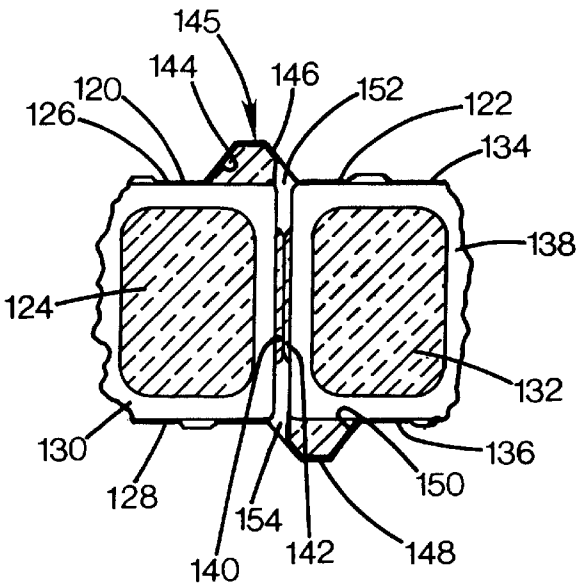
FIG. 9 is a detailed view of the connection of the first and second panel system of FIG. 8.

With reference to FIGS. 8–9, a first panel system 120 is shown being attached to a second panel system 122. The panel system 120 has a semi-rigid core material 124 disposed between a first skin member 126 and a second skin member 128 that are separated by a support member 130, as described above. Similarly, the panel system 122 has a semi-rigid core material 132 disposed between a first skin member 134 and a second skin member 136 that are separated by a support member 138.

As best shown in FIG. 9, the core material 124 has a protrusion 140 that protrudes beyond the support member 130. The core material 132 has a corresponding protrusion 142 that protrudes beyond the support member 138 so that the protrusions 140 and 142 may connect when the first panel system 120 is attached to the second panel system 122. Preferably, the protrusions 140, 142 form a watertight seal therebetween.

The male rib segment 144 may be bonded to the female segment 146 by 3M's VHB very high bond tape 145, or any other suitable bonding method, so that the segment 144 forms a watertight seal with the segment 146. Similarly, the male segment 148 may be bonded to the female segment 150 by a suitable caulking material 149 that is suitable for interior use so that the segment 148 is sealed to the segment 150. In this way, internal gutters 152, 154 may be defined between the protrusions 140, 142, the support members 130, 138, and the outer and inner panel skins.

Should water penetrate the seal between the outer skins, the seal between the foam protrusions 140, 142 prevents the water from penetrating through the panel system, and the water is permitted to run down the interior gutter 152. In the unlikely event that water even penetrates the seal between the protrusions 140, 142, the water is permitted to run down the interior gutter 154 that is disposed inside the seal between the protrusions 140, 142.

Figure 10:
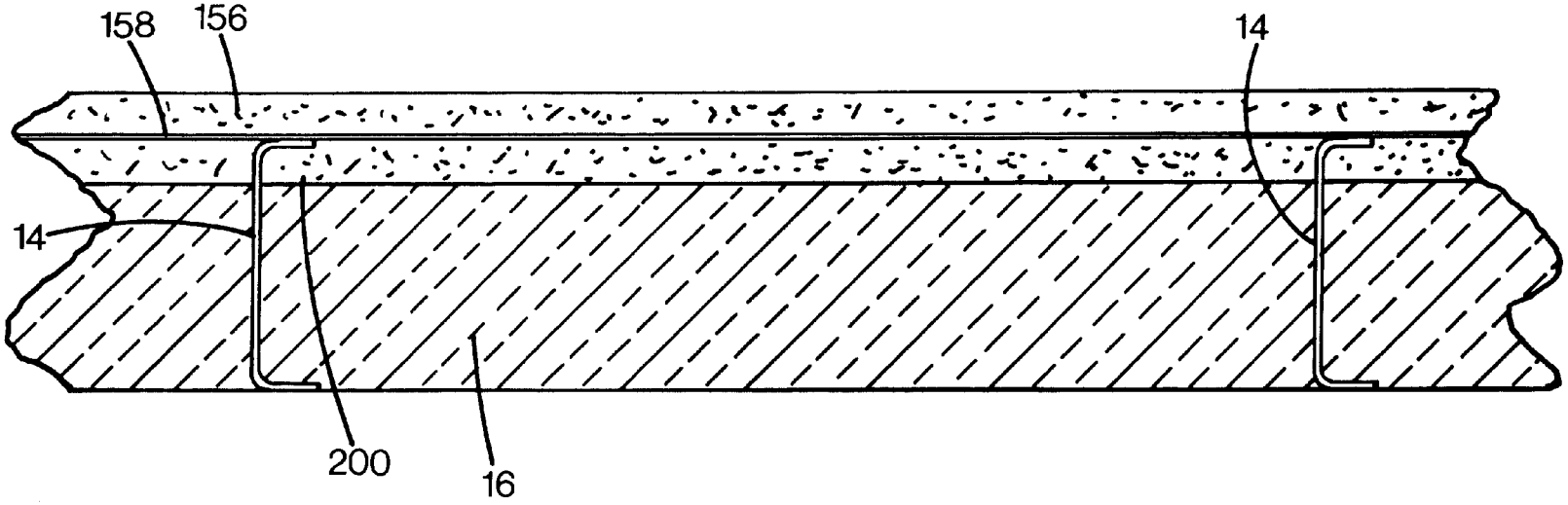
FIG. 10 is a detailed cross-section view along line 10—10 in FIG. 5.

FIG. 10 is a cross-sectional view along of FIG. 5. The support member 14 has a lip portion 200 that extends in a direction that is parallel to the outer cementitious panel 156 and the outer skin member 158. This provides, among other things, a very secure and strong attachment and integrations of cementitious panel member to the structural panel as a whole.

While the present invention has been described in accordance with preferred compositions and embodiments, it is to be understood that certain substitutions and alterations may be made thereto without departing from the spirit and scope of the following claims.

I claim:

1. A structural panel system, comprising:

a first skin member;

a second skin member spaced apart from the first skin member, the second skin member having a plurality of perforation openings defined therein;

a plurality of elongate support members each having long and narrow sides and, attached to the first and second skin members with the long and narrow sides substantially parallel to the first and second skin members, the support members being spaced apart so that the support members and the skin members define a plurality of spaces therebetween;

a cementitious material cast around the second skin member to enclose the second skin member so that both an exterior face and an interior face of the second skin member are covered by a layer of the cementitious material; and a semi-rigid foam core member disposed in the spaces, the semi-rigid foam core member being adhered to the support members, the first skin member, and the cementitious material.

2. The structural panel system according to claim 1 wherein the support members are attached to the first and second skin members by a very high-bond tape member.

3. The structural panel system according to claim 1 wherein the first skin member is bonded with a tape to the support members.

4. The structural panel system according to claim 1 wherein the first skin member is perforated, a semi-rigid foam material of which the core member is made encloses the first skin member and extends along an outside of the first skin member.

5. The structural panel system according to claim 4 wherein the foam material on the outside of the second skin member forms a bonding surface and a third skin member is bonded to the bonding surface.

6. The structural panel system according to claim 1 wherein the second skin member is movable relative to the first skin member.

7. The second panel system according to claim 1 wherein the cementitious material has a longitudinal ridge that protrudes outwardly and a ridge cap is placed on top of the longitudinal ridge.

8. A structural panel system, comprising:

a first skin member;

a second skin member spaced apart from the first skin member;

a plurality of elongate support members each having respective long and narrow sides thereof attached to the first and second skin members, the long and narrow sides of the support members being substantially parallel to the first and second skin members, the support members being spaced apart along the first and second skin members so as to define a plurality of spaced bounded on two sides by the first and second skin members and bounded on two other sides by the support members; and the first skin member, the second skin member and the plurality of support members being adhered together into a structural unit by a core of semi-rigid foam material disposed in the spaces and encapsulating the support members.

9. The structural panel system according to claim 8 wherein the support members are made of a semi-flexible material so that the second skin member is movable relative to the first skin member.

10. The structural panel system according to claim 8 wherein each of the support members has a plurality of openings defined therein.

11. The structural panel system according to claim 8 wherein at least one of the skin members has a ribbed profile and is made of a high tensile steel material.

12. The structural panel system according to claim 8 wherein the second skin member has a plurality of openings defined therein.

13. The structural panel system according to claim 12 wherein the foam material of which the core member is made permeates the second skin member to form a core member surface on an outside of the second skin member.

14. The structural panel system according to claim 12 wherein the foam material of which the core member is made permeates the second skin member and bonds to a third skin member.

15. The structural panel system according to claim 12 wherein a cementitious material is cast around the second skin member to enclose the second skin member so that both an exterior face and an interior face of the second skin member are covered by a layer of the cementitious material.

16. The structural panel system according to claim 8 wherein the support members have different heights so that a first thickness at a middle portion of the structural panel system is different from a second thickness at an end of the structural panel system.

17. The structural panel system according to claim 8 wherein the core member is made of a semi-flexible polyurethane foam material.

18. A structural panel system according to claim 8, wherein each of the plurality of support members comprises a connecting member having a first end and an opposite second end, a first side member attached to the first end, and a second side member attached to the second end, the first and second side members being perpendicular to the connecting member and extending along an entire length of each support member and including the long and narrow sides thereof, and wherein the connecting member extends from the first skin member to the second skin member and the first and second side members are substantially parallel to and extend along the first and second skin members, respectively.

19. A structural panel system according to claim 8, wherein the second skin member is perforated and the semi-rigid foam material of which the core is made encloses the second skin member and extends along an outside of the second skin member.

20. In combination, two of the panel systems of claim 8, wherein a first one of the two structural panel systems is attached to a second one of the two structural panel systems along a respective confronting side of the two structural panel systems, the core of each of said two structural panel systems protruding toward the other of said two structural panel systems and the cores being in mating contact with each other, and wherein each of the two structural panel systems has along the confronting side thereof a male rib on one of its first and second skin members and a corresponding female segment on the other of its first and second skin members, the male rib of each of the two structural panel systems being matingly located in the female segment of the other of the two structural panel systems, the two structural panel systems thereby defining a first internal gutter between the core members and the first skin members and a second internal gutter between the core members and the second skin members of the two structural panel systems.

* * * * *